US009072135B2

(12) United States Patent
Chakravarty et al.

(10) Patent No.: US 9,072,135 B2
(45) Date of Patent: Jun. 30, 2015

(54) SYSTEMS AND METHODS FOR MODULAR AND CONFIGURABLE DRIVER SYSTEM FOR LED LIGHTING DEVICES

(76) Inventors: Jyotirmoy Chakravarty, Boerne, TX (US); Sarosij Sengupta, Haryana (IN)

( * ) Notice: Subject to any disclaimer, the term of this patent is extended or adjusted under 35 U.S.C. 154(b) by 51 days.

(21) Appl. No.: 13/607,852

(22) Filed: Sep. 10, 2012

(65) Prior Publication Data

US 2014/0070731 A1 Mar. 13, 2014

(51) Int. Cl.

| | |
|---|---|
| ***H05B 37/00*** | (2006.01) |
| ***H05B 43/00*** | (2006.01) |
| ***H05B 33/08*** | (2006.01) |
| ***H05B 37/02*** | (2006.01) |
| ***F21V 23/00*** | (2015.01) |
| *F21W 131/103* | (2006.01) |

(52) U.S. Cl.

CPC ..... *H05B 33/0803* (2013.01); *H05B 33/0842* (2013.01); *H05B 37/0245* (2013.01); *F21V 23/007* (2013.01); *F21W 2131/103* (2013.01)

(58) Field of Classification Search

USPC ..... 315/312, 160, 161; 362/249.02, 294, 362/373

See application file for complete search history.

(56) References Cited

U.S. PATENT DOCUMENTS

| | | | | |
|---|---|---|---|---|
| 7,922,372 | B2 * | 4/2011 | Li | 362/373 |
| 2011/0013395 | A1 * | 1/2011 | Melzner et al. | 362/240 |

* cited by examiner

*Primary Examiner* — Daniel D Chang

(74) *Attorney, Agent, or Firm* — Helix Patent Services LLC

(57) ABSTRACT

A modular LED power supply is provided. The modular LED power supply includes a docking module having a plurality of grooves for receiving a plurality of power supply driver modules. The plurality of power supply driver modules are modular in nature and are attached to the plurality of grooves in the docking module based on the power requirements, Also, the modular LED power supply includes a supervisory module for analyzing and controlling the number of power supply driver modules required to be attached to the docking module.

5 Claims, 3 Drawing Sheets

SYSTEMS AND METHODS FOR MODULAR AND CONFIGURABLE DRIVER SYSTEM FOR LED LIGHTING DEVICES

FIELD OF THE INVENTION

The invention disclosed herein relates generally to Light Emitting Diode (LED) lighting devices. In particular, the invention relates to systems and methods for intelligent and distributed driver configuration of the LED lighting devices.

BACKGROUND OF THE INVENTION

Demand for energy-efficient Solid State Lighting (SSL) based lighting devices is driven by various factors such as improved energy efficiency, enhanced product life, lower maintenance costs, and reduced environmental impact. An example of the SSL based lighting devices that uses inorganic semiconductors is a Light Emitting Diode (LED) lighting device.

In a lighting system, a constant-current driver circuitry is provided for conversion of AC power input into constant-current power output. The constant-current DC power output is subsequently delivered to the LED lighting devices. As the conversion from AC line voltage to milliamperes of constant DC current is critical to the functioning of the LED lighting devices, efficiency of the driver circuitry is very important. Performance quality of the constant-current driver circuitry is determined by several factors such as input AC voltage range, line surge protection, conversion to output DC constant-current and most importantly, the output power requirement. The efficiency of the LED driver circuitry is critically dependent on output LED load and how wide the range of input voltage.

The impact of loss in efficiency of a power supply unit will increase power usage, reduced light output per watts of power usage and reduce reliability of the power supply unit and increase chances of field failures. The loss in efficiency is dissipated in form of heat and heat in electronic circuitry is one of the main contributors to reduction in life expectancy of electronic components. In order to improve reliability and increase Mean time between failures (MTBF) of the drivers lighting system efficiency must be increased and losses reduced.

Generally, a LED power supply driver is disposed inside or outside of the LED lighting device. Such an arrangement decreases the distance between power supply and a LED lighting device base thereby, preventing an output power drop from an output of the power supply to the LED lighting device base. The production and installation can be more convenient if one or more than one power supply is disposed in a groove of a main heat-dissipating outer cover of the power supply.

It is possible to design power drivers to be optimized for output LED load and a smaller range of input voltage; however, since LED fixtures inherently built to meet lumen output load the concept of customized drivers for different LED loads would become unpractical and expensive. This invention provides an innovative solution. It provides modularity and creates highly manageable and efficient product.

In light of the above discussion, there is a need for an improvement in LED power supply system in order to optimize output drive capability of the LED power supply system over smaller ranges of power input and driver loads.

BRIEF DESCRIPTION OF THE DRAWINGS

Features of the present invention are set forth with particularity in the appended claims. These features, advantages and objects of the present invention will be further understood and readily appreciated by those skilled in the art by reference to the following detailed description and claims taken in conjunction with the accompanying drawings, wherein:

SUMMARY OF THE INVENTION

Figure 1:
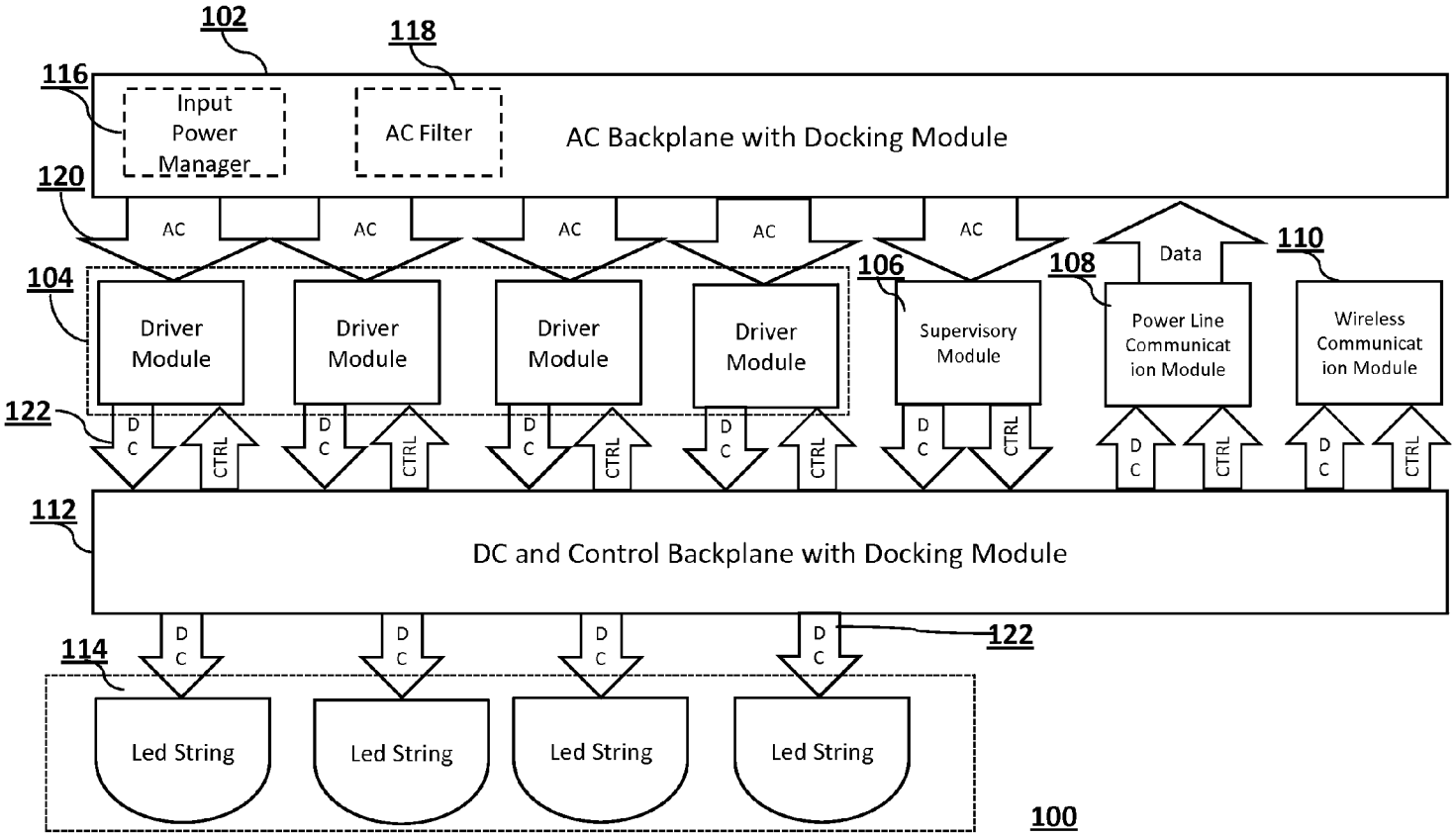
FIG. 1 illustrates a block diagram of the product 100 in accordance with the principles of the present invention.

In accordance with an embodiment, the system includes an AC backplane, a DC and Control backplane and a plurality of LED strings. The AC backplane includes an AC filter section. The backplane is setup to provide signal connectivity to and from each module through plug in connectors. The backplane provides connectivity between various functional blocks such as micro-controller supervisory module, driver modules and light fixture to light fixture communication.

Embodiments of the invention provide a creation of DC constant current driver designed to operate as independent drivers for LED loads. These drivers are constructed in modular increments that can electrically plug into the backplane to be able to drive cumulative single fixture load. The control of these driver modules is provided by the microcontroller in the supervisory module.

Further embodiments of the invention permit the microcontroller in the supervisory module to control the independent drivers for On, Off and Dimming of the fixture.

In accordance with some embodiments of the invention, each of the plurality of discrete power supply driver modules includes a rectifier with power factor corrector and a feedback and current control unit. The rectifier converts AC power input into constant-current power output and delivers the constant-current power output to a corresponding LED string of the plurality of LED strings. The feedback and current control unit controls supply of the constant-current power output to the corresponding LED string based on corresponding information in the data received by the DC and Control backplane on the system health.

An object of the present invention is to provide a LED power supply system that enables optimizing the output drive capability over smaller ranges of power input. The LED power supply system includes the plurality of discrete power supply driver modules such that each of the plurality of discrete power supply driver modules is connected in parallel.

Another object of the present invention is to provide a method that will improve reliability and efficiency of the LED power supply system by minimizing heat generated by the LED power supply system and also provide consistent efficacy of the light fixture irrespective of the size of the LED load.

Yet another object of the present invention is to provide an intelligent and distributed driver configuration of LED lighting devices wherein a LED power supply unit failure is limited to an LED string driven by a corresponding LED power supply driver module while other LED strings continue to function.

In an embodiment of the invention, the intelligent and distributed driver configuration is provided so as to minimize the various losses and at the same time, allowing the LED power supply unit to have multiple LED loads. The LED power supply system based on such driver configuration will have an improved manufacturing reliability and robustness.

DETAILED DESCRIPTION OF EXEMPLARY EMBODIMENTS

Before describing the present invention in detail, it should be observed that the present invention utilizes apparatus components and method steps to describe systems and methods related to intelligent street lights. Accordingly, the apparatus components and the method steps have been represented, wherever appropriate, by conventional symbols in the drawings, showing specific details that are pertinent for an understanding of the present invention. Only the specific details are shown so as not to obscure the disclosure with details that will be readily apparent to those with an ordinary skill in the art having the benefit of the description herein.

While the specification concludes with the claims defining the features of the present invention that are regarded as novel, it is believed that the present invention will be better understood from a consideration of the following description in conjunction with the drawings, in which like reference numerals are carried forward.

As required, detailed embodiments of the present invention are disclosed herein; however, it is to be understood that the disclosed embodiments are merely exemplary of the present invention, which can be embodied in various forms. Therefore, specific structural and functional details disclosed herein are not to be interpreted as limiting, but merely as a basis for the claims and as a representative basis for teaching one skilled in the art to employ variously the present invention in virtually any appropriately detailed structure. Further, the terms and phrases used herein are not intended to be limiting, rather they provide a better understanding of the description of the present invention.

The terms "a" or "an", as used herein, are defined as one or more than one. The term "another", as used herein, is defined as at least a second or more. The terms "including" and/or "having" as used herein, are defined as comprising (i.e. open transition).

Figure 2:
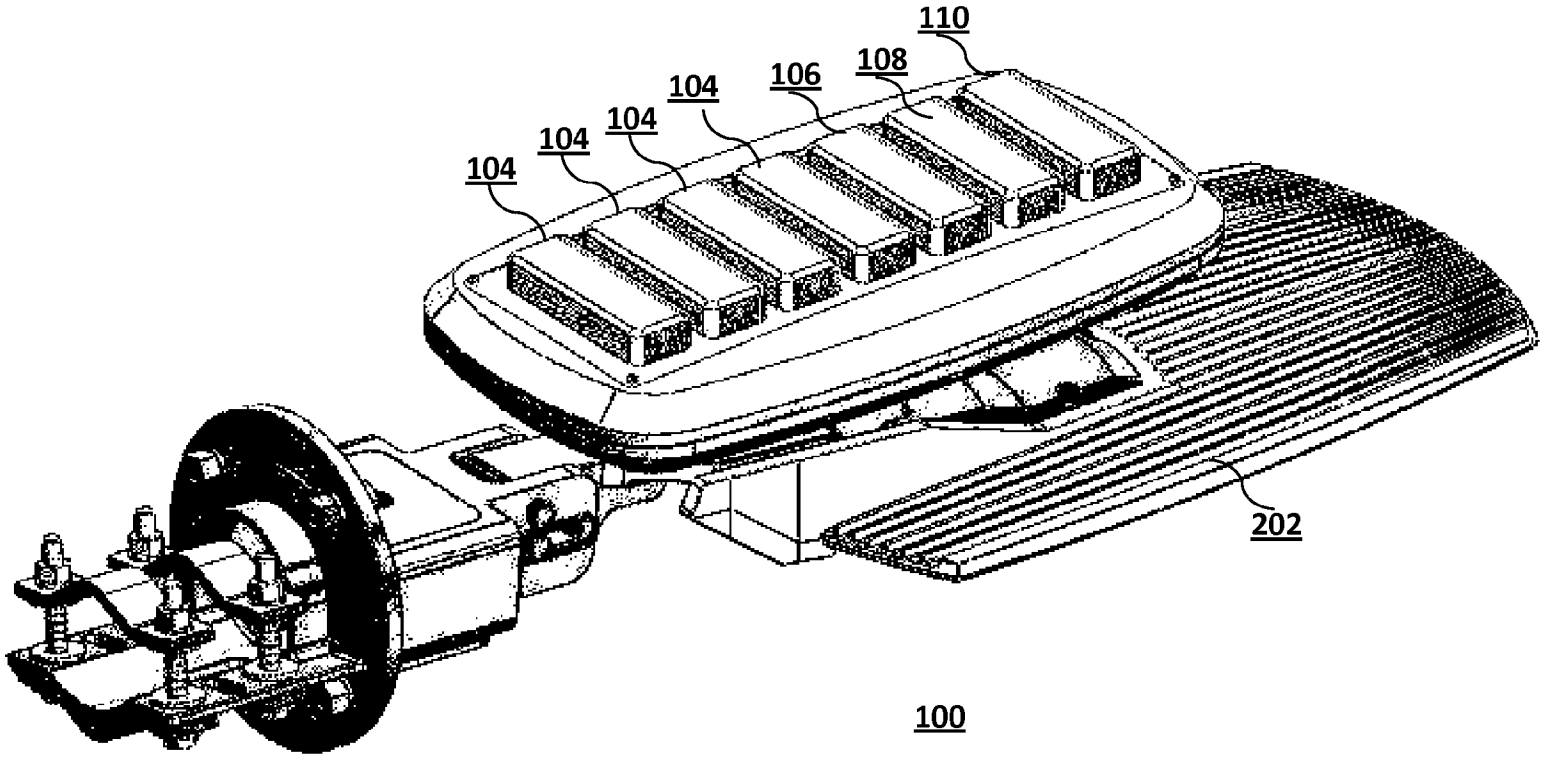
FIG. 2 illustrates mechanical layout of a product 100 constructed in accordance with the principles of the present invention.

With reference to the invention as depicted in FIGS. 1 and 2, an overall construction of the product 100 based on the invention and a plurality of LED strings 114 assembled on a casing 202 together having an intelligent and distributed driver configuration that is configured in accordance with certain features, aspects and advantages of the present invention is described. A constant-current driver circuitry provides for conversion of AC power input into constant-current power output and subsequently, delivering the constant-current power output to the plurality of LED strings 114.

According to an embodiment of the present invention, an intelligent and distributed driver configuration which drives the plurality of LED strings 114 includes a power backbone that is specifically designed to filter AC power input and provide adequate protection to the constant-current driver circuitry against power surges. Functional blocks that are part of the power backbone include an AC backplane 102, a DC and Control backplane 110, a plurality of discrete power supply driver modules 104, a supervisory module 106, a power line communication (PLC) module 108 and a wireless communication module 110.

The AC backplane 102 derives input power from a three-phase AC transmission line that includes an input power manager 116 and an AC filter 118. Further, it is setup with plug in connectors (ac power input connector 120 and dc power output connector 122) into which each of the plurality of discrete power supply driver modules 104 and the supervisory module 106 plug in. The AC filter 118 is used to remove contamination in electrical signals thereby, providing clean power for distribution to each of the plurality of discrete power supply driver modules 104. The clean power delivered to each of the plurality of discrete power supply driver modules 104 drives a corresponding LED string of the plurality of LED strings 114.

Each of the plurality of power supply driver modules 104 includes rectifiers with power factor corrector for conversion of the AC power input into the constant-current power output. Further, each of the plurality of discrete power supply driver modules 104 is tuned and optimized to operate over a small range of output load thus maximizing system efficiency.

The supervisory module 106 provides intelligence to the LED power supply system 100. It is the key to enhancing the efficiency and reliability of the LED power supply system 100. It includes an auxiliary rectifier and a DSP based micro controller. The auxiliary rectifier acts a power source for the DSP based micro controller circuitry, the power line communication (PLC) module 108 and the wireless communication module 110.

The DSP based micro controller is provided to control, regulate and monitor the performance of the plurality of discrete power supply driver modules 104, and ultimately the plurality of LED strings 114.

According to an embodiment of the present invention, each of the plurality of discrete power supply driver modules is connected in parallel. As a result, if there is a fault in one or more than one of the plurality of discrete power supply driver modules 104, remainder of the plurality of discrete power supply driver modules 104 will continue to function.

Figure 3:
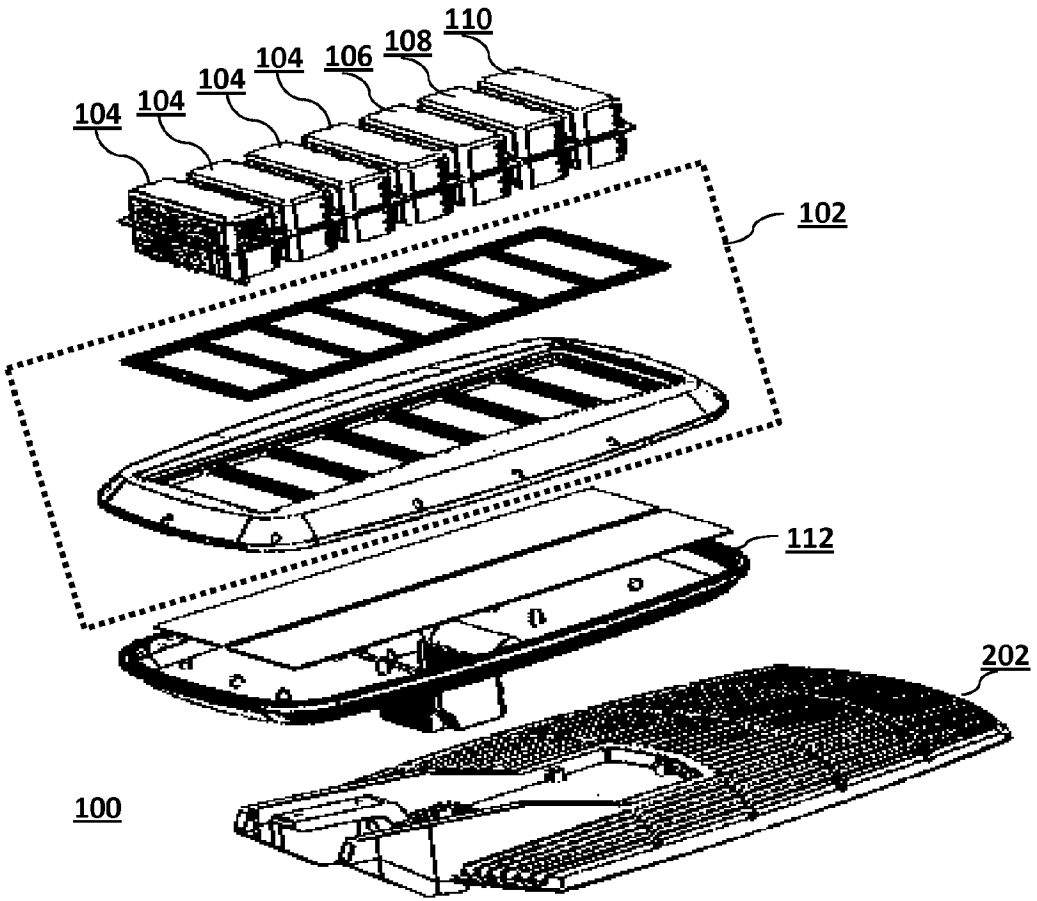
FIG. 3 is a dispersed view of the product 100 constructed in accordance with the principles of the present invention, illustrating various modules comprising the product in an assembling sequence.

Referring to FIG. 2, the product is shown constructed in accordance with embodiments of the present invention. Also, shown in FIG. 3 is a dispersed view of the product constructed in accordance with the embodiments of the present invention. An assembling sequence is shown to illustrate the modular aspect of the product 100, which enables easy repair and/or replacement of a component as and when desired. As can be seen one or more power supply driver modules 104 can be disposed in a groove of the main power supply module according to the actual requirements, so that the production and installation thereof become more convenient. Further, the power supply has the advantages of by being water-resistant, moisture-proof, dust-proof, antirust and heat-dissipating. Also, the one or more power supply driver modules 104 enable the efficiency losses to be reduced. For example, in a real life application, a device 100 works at highest efficiency when the actual requirement matches the power supply. However, if the power supply is more and the actual requirement is less there will be a loss in efficiency. Therefore this modular system 100 enables matching of the power supply to the actual requirements and reducing efficiency loss due to hysteresis.

The invention claimed is:

1. A modular LED system comprising: an ac backplane, dc and control backplane, LED strings and a modular LED power supply wherein the modular LED power supply comprising:

a. a docking module with a plurality of grooves inside and a plurality of heat-dissipating fins on a surface;

b. a plurality of power supply driver modules, wherein the plurality of power supply driver modules are modular in nature and are attached to the plurality of grooves in the docking module; and c. a supervisory module for analyzing and controlling the number of power supply driver modules required to be attached to the docking module;

wherein the backplanes are configured to provides signal connectivity to and from each module through plug in connectors to reduce output voltage drop.

2. The modular LED power supply of claim 1, wherein the modular LED power supply can be used as a power supply to an LED street light.

3. The modular LED power supply of claim 1 further comprising an AC power input connector, a DC power output connector, a power line communication module and a wireless communication module.

4. The modular LED power supply of claim 1, wherein the plurality of grooves have a bottom plate, side walls and an attachment hole disposed thereon.

5. The modular LED power supply of claim 1, wherein the plurality of power supply drivers modules enable reduction in hysteresis loss are connected in parallel with each other and further disposed in a groove of main power supply module to reduce loss in efficiency due to faulty lines and hysteresis.

* * * * *